US006887409B2

(12) United States Patent
Kosan et al.

(10) Patent No.: US 6,887,409 B2
(45) Date of Patent: May 3, 2005

(54) METHOD AND DEVICE FOR THE PRODUCTION OF CELLULOSE FIBERS AND CELLULOSE FILAMENT YARNS

(75) Inventors: Birgit Kosan, Rudolstadt (DE); Christoph Michels, Rudolstadt (DE)

(73) Assignee: Thuringishces Institut fur Textil und Kunststoff-Forschung E.V., Rudolstadt (DE)

( * ) Notice: Subject to any disclaimer, the term of this patent is extended or adjusted under 35 U.S.C. 154(b) by 333 days.

(21) Appl. No.: 10/220,870

(22) PCT Filed: Mar. 6, 2001

(86) PCT No.: PCT/DE01/00901

§ 371 (c)(1),
(2), (4) Date: Oct. 29, 2002

(87) PCT Pub. No.: WO01/68958

PCT Pub. Date: Sep. 20, 2001

(65) Prior Publication Data

US 2003/0116882 A1 Jun. 26, 2003

(30) Foreign Application Priority Data

Mar. 11, 2000 (DE) ..... 100 11 948

(51) Int. Cl.[7] ..... B29C 47/34; B29C 55/00; B29C 47/12; B29D 7/00

(52) U.S. Cl. ..... 264/83; 264/177.11; 264/177.17; 264/178 R; 264/187; 264/218; 425/66

(58) Field of Search ..... 264/83, 177.11, 264/177.17, 178 R, 187, 218; 425/66

(56) References Cited

U.S. PATENT DOCUMENTS 6,670,469 B1 * 12/2003 Beyer et al. ..... 536/56
6,676,739 B2 * 1/2004 Kosan et al. ..... 106/200.2

* cited by examiner

*Primary Examiner*—Stephen J. Lechert, Jr.
(74) *Attorney, Agent, or Firm*—Marianne Fuierer; Steven J. Hultquist; Yongzhi Yang

(57) ABSTRACT

A method for the production of cellulose fibers or filaments from cell material, by the dry-wet extrusion method with aqueous amine oxides, in particular, N-methylmorpholine-N-oxide as solve is described comprising the following steps: a) dispersion of a cell material, or a cell material mixture with a cuoxam DP from 250–3000, in aqueous amine oxide, b) transformation of the obtained dispersion, by water evaporation with shear, at elevated temperature, into a homogeneous solution with a zero shear viscosity of 600 to 6000 Pa·s and a relaxation time of 0.3 to 50 seconds all at 85° C., c) feeding the solution to a spinning jet, previous to which it is passed through flow chamber prior the jet(s), in which the retention time at the spinning temperature, d) forming the solution into at least one capillary in each spinning jet, drawing the capillary(ies) from each jet through anon-precipitating medium and then precipitating the cellulose fibers on drawing through a precipitating bath and e) at the end of the precipitating bath section drawing off the fibers by deflecting the precipitation flow. In stage d) the capillary bundle(s) are treated with a gas flow, just before the entry thereof into the precipitating bath, at an angle $\alpha$ to the capillary flow, wherein $45° < \alpha < 90°$.

10 Claims, 2 Drawing Sheets

METHOD AND DEVICE FOR THE PRODUCTION OF CELLULOSE FIBERS AND CELLULOSE FILAMENT YARNS

CROSS-REFERENCE TO RELATED APPLICATIONS

This application is filed under the provisions of 35 U.S.C. §371 and claims the priority of International Patent Application No. PCT/DE01/00901 filed Mar. 6, 2001, which in turn claims priority of German Patent Application No. 100 11 948.4 filed on Mar. 11, 2000.

BACKGROUND OF THE INVENTION

1. Field of Technology

The main application relates to a method for the production of cellulose fibers or -filaments from cellulose according to the dry-wet-extrusion process with aqueous amine oxides, especially N-methyl-morpholine-N-oxide as solvent, where a) cellulose or a cellulose mixture is dispersed with a Cuoxam-DP in the range of 250 to 3,000 in aqueous amine oxide, b) the dispersion obtained in this manner is transferred at an increased temperature under dehydration and shearing into a homogenous solution with a zero shear viscosity in a range of 600 to 6,000 PAs and a relaxation time in a range of 0.3 to 50 s at 85° C. respectively; c) the solution is supplied to at least one spinning nozzle and first guided through an impaction chamber shared by one nozzle or a plurality of nozzles where its dwelling time is at least equal to its relaxation time at the spinning temperature, d) the solution is formed in each spinning nozzle into at least one capillary and the capillary (or capillaries) of each nozzle are guided under drawing through a non-precipitative medium and then through a spinning bath under precipitation of the cellulose threads, and e) the cellulose threads are separated at the end of the spinning bath drawing frame by diversion from the spinning bath flows and the threads are pulled off. The main application furthermore relates to a device for the production of cellulose fibers or -filaments from cellulose according to the dry-wet-extrusion process with aqueous amine oxides as solvents with a spinning package having a spinning nozzle plate, spinning nozzles and a shared impaction chamber arranged above the spinning nozzle plate and the spinning nozzles arranged in a row, with the volume of the shared impacting chamber satisfying the equation $V \geqq v_L * \lambda_m$, wherein V represents the volume of the impaction chamber in $cm^3$, $v_L$ represents the flow of the volume of the cellulose solution in $cm^3/s$ and $\lambda_m$ represents the relaxation time at the frequency maximum of the relaxation spectrum of the spinning solution, furthermore with a spinning bath in two containers connected by a spinning bath pump, a gap between the spinning nozzles and the spinning bath surface in the upper of the two containers, and a drawing off godet.

2. Description of Related Art

The main application was based on the problem to provide a method and a device that allows the spinning of fibers and the multiple spinning of filament yarns with good mechanical fiber properties at a high capillary density, spinning safety and drawing-off speed. In particular, the objective was to improve the smoothness and evenness of the volume flows through each nozzle compared to the known methods.

SUMMARY OF THE INVENTION

The main application states that the width of the gap a correlates on the one hand with the relaxation time $\lambda_m$ of the spinning solution at the frequency maximum of the relaxation time spectrum at the spinning temperature and the drawing-off speed $v_a$ (Equation II) and on the other hand with the distance x between two adjacent nozzle holes, the length of the spinning bath drawing frame w and the nozzle hole diameter D (Equation III). Because the relaxation time is within a second range and the dwelling time of the formed solution in the gap a is within a millisecond range, it should be possible to achieve significantly larger gap widths than previously during practical operation. For the spinning of fibers and filaments, the maximal settable gap, i.e., the drawing frame on which the "solution thread" is orientated to a greater or lesser extent corresponding to the drawing-off ratio, is of special importance. The strain rate and thus the tension of the thread decrease as the width of the gap increases. This has a positive effect on the mechanical fiber parameters, especially the elongation at tear and the loop tear strength. On the other hand, the spinning safety decreases as the width of the gap increases because risk of capillary contact increases. This applies in particular to the spinning of fibers, where the capillary density is as high as possible anyway. Thus, it is essential to set a maximum gap that satisfies the spinning safety, but also yields optimal mechanical fiber parameters. In addition, the decrease of thread tension is a prerequisite for increasing the drawing-off speed, especially for the spinning of filament yarns.

In the sense of the main application, the problem to be solved by the present invention is therefore to provide a method and a device that allows the spinning of fibers and the multiple spinning of filament yarns with good mechanical fiber properties at a high capillary density, spinning safety and drawing-off speed. In particular, the goal was to improve the mechanical fiber properties, i.e., the elongation at tear and the loop tear strength, while maintaining the spinning safety. An additional goal was to increase the drawing-off speed, especially for the spinning of filament yarns.

The object of the invention was attained with the method according to the invention mentioned in the preamble, in that in step d), the capillary assemblage(s) are impacted shortly before they enter the spinning bath with a gas under an angle $\alpha$ to the direction of capillary travel in the range of $45° < \alpha < 90°$. Surprisingly, it was found that this allows for a substantial increase of the gap with, i.e., by more than 50 to 100%, without any adverse effect on the spinning safety. The reduced strain rate and thread tension in the gap due to the larger gap width leads to the desired improvement of the aforementioned mechanical fiber parameters and the possibility of increasing the drawing-off speed.

The object of the invention is attained in particularly also because in step d), the capillary assemblage is impacted with a gas immediately before it enters the spinning bath, whereby the spinning bath at the boundary surface to the air gap and the flow of gas have impaction components in the same direction. The effect of increasing the maximum gap width is thus also attained if the flow of gas and the flow of the spinning bath have horizontal flow components acting in the same direction.

The capillary assemblages are appropriately impacted with a flat, level flow of gas that reaches across the entire width of the row of capillary assemblages. In doing so, it is important that the flow of gas becomes effective where the capillary assemblages immerse into the spinning bath. The spinning failures, which impair spinning safety and are caused almost exclusively by capillary contact during entry into the spinning bath, are substantially reduced. Surprisingly, it was found that despite the impaction of the capillary assemblages with the flow of gas, the movement of the surface of the spinning bath is calmed when the capillary assemblages immerse. Generally, it can be said that the impaction of the capillary assemblages causes a mechanical effect at the point of immersion; in particular, the cooling of the capillary assemblages does not play a role.

The problem with the device of the aforementioned type is furthermore solved in accordance with the invention in that at least one wide-slot nozzle with a nozzle slot directed under an angle $\alpha$ to the capillary direction in the range $45° < \alpha < 90°$ is arranged in the gap for the impaction of the capillaries prior to their entry into the spinning bath. The width of the slot can be 0.05 to 5 mm, for example 1 mm. The length of the slot corresponds at least to the length of the row of capillary assemblies to be impacted. They are preferably arranged in a row (not in several successively staggered rows), so that all assemblages are impacted by the flow of gas in the same way.

Preferably, the device of the aforementioned type is characterized in accordance with the invention in that the upper bath container has on the one side of the capillary assemblages at least one inlet opening for spinning bath liquid and on the other side of the capillary assemblages has at least one overflow, and the wide-slot nozzle is arranged on the same side as the inlet opening(s) with respect to the row of capillary assemblages. In that way, the spinning bath liquid and the flow of gas in the gap have parallel horizontal flow components, which promotes the increase of the maximum gap width.

Preferably, the wide-slot nozzle is mechanically connected to the overflow, of which there is at least one. Thus, the gas wide-slot nozzle always has the same (short) distance from the surface of the spinning bath, regardless of the vertical setting of the overflow and thus the size of the gap width.

The aforementioned device for the production of cellulose fibers or -filaments is characterized in accordance with the invention in that the width of the gap a and the relaxation time of the spinning solution meet the following equation:

$$a \leq [5 + 16\lambda_m^{0.6}] \cdot e^{0.002 v_a + \frac{1}{\sqrt{N \cdot D}}} \qquad \text{(IIa)}$$

where a represents the gap width in mm, $\lambda_m$ represents the relaxation time at the frequency maximum of the relaxation spectrum of the spinning solution, $v_a$ represents the drawing-off speed in m/min, N represents the capillary density in $cm^{-2}$ and D represents the diameter of the nozzle hole in mm. The term $1/\sqrt{N \cdot D}$, which was added compared to the equation II in the main application, takes into account the increase of the gap width achieved in accordance with the invention due to the impaction of the capillary assemblages shortly before their contact with the spinning bath. It is obvious that this gap increase becomes less as the capillary density increases.

Preferably, the dimensions of the spinning nozzles, the gap width a and the spinning bath drawing frame w satisfy the equation $$x \geq \frac{a + w}{w} \cdot 3,5D \qquad \text{(IIIa)}$$

where x represents the distance between two adjacent nozzle holes, a represents the width of the gap, w represents the length of the spinning bath drawing frame and D represents the diameter of the nozzle. The comparison with equation III of the main application shows that the distance between two adjacent nozzles holes of the nozzle can be decreased by ⅛ with the impaction of the capillary assemblage(s) without any adverse effect on the objectives of the invention, i.e., maintaining the spinning safety while improving the mechanical properties of the fibers.

BRIEF DESCRIPTION OF THE DRAWINGS

The invention is explained in greater detail by means of the illustration and the example. Shown are.

DETAILED DESCRIPTION OF THE INVENTION

Figure 3:
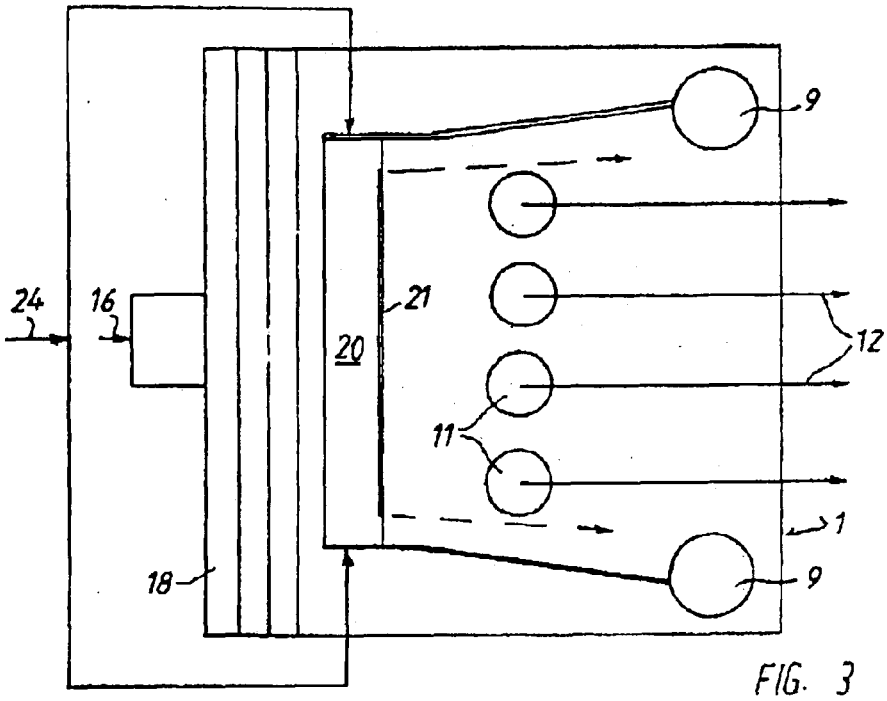
Figure 2:
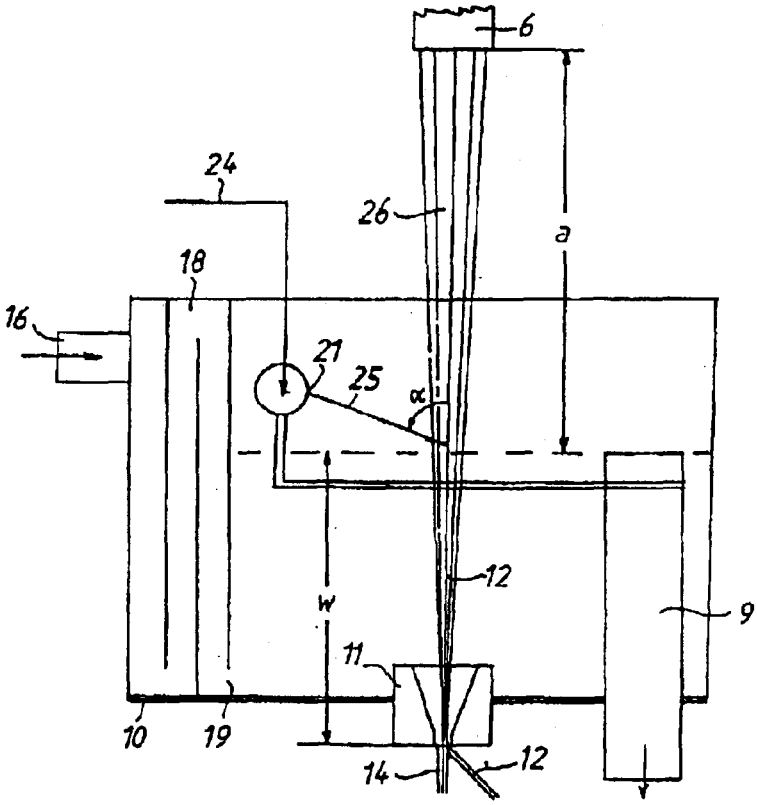
FIG. 2 the schematic representation of a device for the production of cellulose fibers and -filaments, and FIG. 3 the schematic top view of the device shown in FIG. 2.

The FIGS. 2 and 3 show the upper spinning bath container 1 of a spinning device in accordance with the invention. The spinning nozzles 6, of which only one is shown in FIG. 2, have impaction chambers as shown and described in greater detail in the main application. The outflow sides of the spinning nozzles 6 have a distance from the spinning bath surface 7 that forms the air gap a. The floor 10 of the spinning bath container 1 is equipped with several thread guide elements 11 according to the arrangement of the nozzles 6, and the thread bundles 12 exit the container 1 together with the spinning bath liquid flows 14 through said thread guide elements. The thread bundles 12 of all thread guide elements 11 are deflected by the spinning bath flows 14 under an angle and rolled up with appropriate tensile stress. The spinning bath flows 14 reach the lower spinning bath container (not shown) and are pumped back into the upper spinning bath container 1 through the line 16 by means of a pump (not shown). The thread bundles 12 pass the spinning bath drawing frame w, which reaches from the surface of the bath to the point below the thread guide elements 11 where the thread bundles 12 separate from the spinning bath liquid flows 14. The line 16 runs into a settling chamber 18 that is partially filled with filler bodies (not shown) and the spinning bath liquid flows from said settling chamber 18 through the openings 19 into the actual container 1. FIG. 3 shows that the thread guide elements 11 are arranged in the floor 10 in a row and the thread bundles 12 run next to one another parallel to the drawing-off godet (not shown).

The spinning bath container 1 has two overflows 9 that can be adjusted vertically and thus determine the level of the spinning bath and the width of the gap a. At the overflows 9, a nozzle tube 20 with a slot 21 that reaches across the row of the nozzles 6 and/or the row of the capillary assemblages 26 is attached by means of the holders 23. The nozzle tube 20 is loaded on both sides with a weak flow of air through the line 24, and said flow of air can be adjusted through a needle valve (not shown). The flow of air 25 leaves the slot 21 (150 mm×1 mm outlet opening) in the shape of a line across the entire width and slants towards the bath surface 7 so that the capillary assemblages come into contact with the flow of air immediately prior to their entry into the spinning bath. The slotted nozzle is located approximately 10 mm above the surface of the spinning bath.

Figure 1:
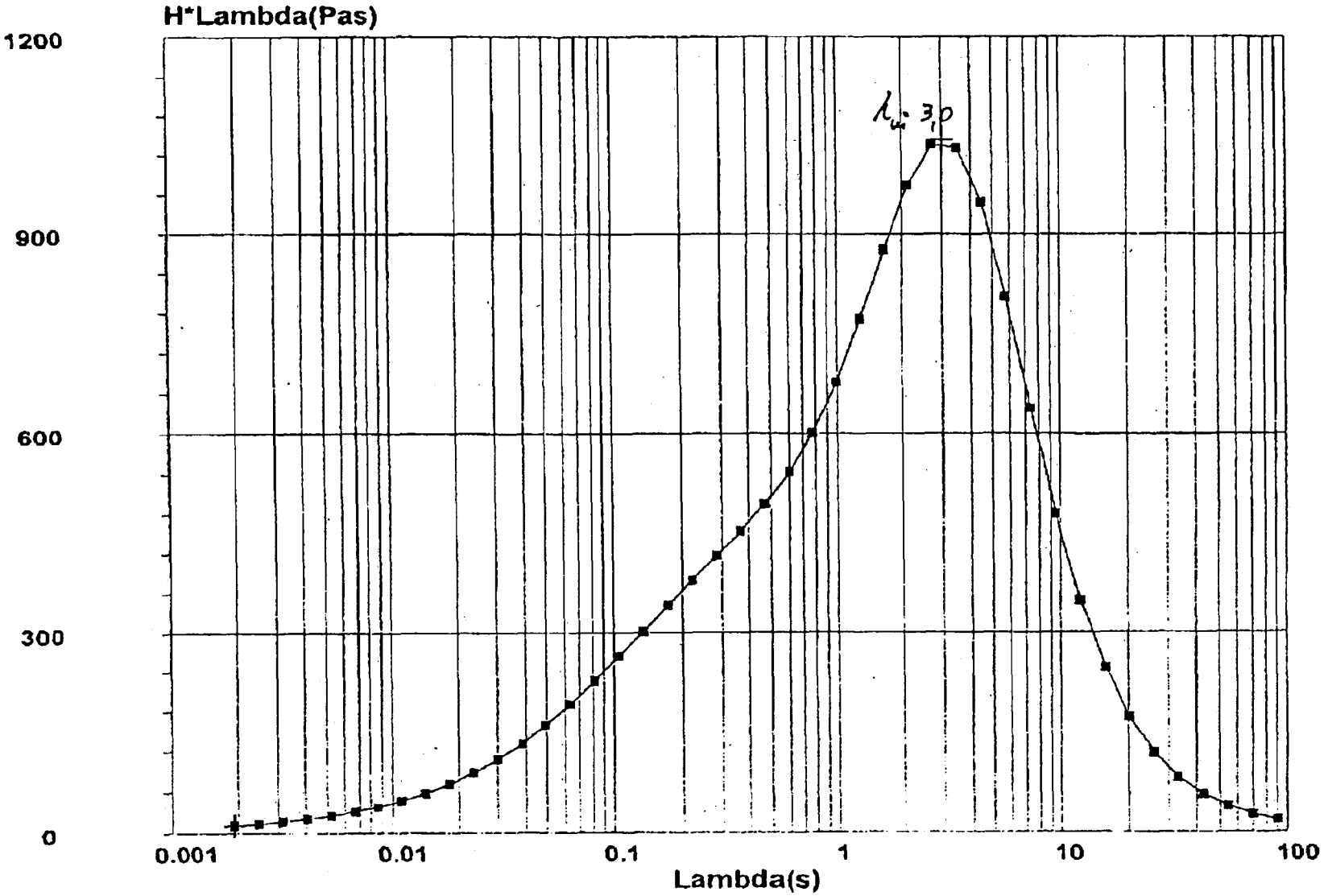
FIG. 1 the relaxation time spectrum of a spinning solution with 12 percent-by-mass cellulose (Cuoxam-DP 480) at a spinning temperature of 85° C.

It was found that when using the device according to the FIGS. 2 and 3, but at first without any air blow of the capillary assemblages by means of the arrangement 20, 21 in the direction of the immersion point of the capillaries into the spinning bath, and when using four monofil nozzles, i.e., four thimble nozzles (12.5 mm diameter) with only one respective 200 $\mu$m diameter boring, the width of the gap a can be changed continuously between 10 and 300 mm during spinning without any noticeable spinning failures. The spinning apparatus did not allow a gap width a>300 mm. The experiments were performed with a 12 percent-by-mass cellulose solution in aqueous N-methyl morpholine-N-oxide (NMMO) which had the relaxation time spectrum shown in FIG. 1 and an $\lambda^m$ of 3.0 s. To determine the relaxation time from the rheological data of the cellulose solution, reference is made to Ch. Michels, Das Papier, (1998), pages 3 to 8. The drawing-off speed was 100 meters per minute. Increasing the drawing-off speed to 300 meters per minute led to the same results. When replacing the thimble nozzles with nozzles having 30 140-$\mu$m diameter borings each, the maximum failure-free gap a drops to approximately 40 to 60 $\mu$m.

With the same arrangement, but with a linear, planiform blow on the capillary assemblages shortly before they enter the spinning bath, a clear increase of the maximum possible gap width a from approximately 40 to 65 mm and/or from approximately 60 to 100 mm could be noted. In addition to the increase of the maximum possible air gap, a significant settling of the capillary run at the entry into the spinning bath could be noted. The frequency of capillary contact clearly decreases, and with it also the probability of spinning failures.

When using nozzles with a nozzle hole diameter of 90 $\mu$m, the maximum operationally safe adjustable gap width a increases, and when using nozzles with a diameter of 200 $\mu$m, said gap width decreases. An increase of the maximum adjustable gap could be noted in the transition to thimble nozzles (20 mm diameter) with the same number of borings, i.e., with decreasing capillary density. With 30 borings per nozzle, the capillary density of the small thimble nozzle is N=47 $cm^{-2}$ and that of the large thimble nozzle is 15 $cm^{-2}$. With a capillary density of 15 $cm^{-2}$, but under otherwise equal conditions, the maximum possible gap width increases again from approximately 65 to 90 mm and/or from 95 to 130 mm. These changes can be described sufficiently with the aforementioned changed equation IIa. With the help of the method in accordance with the invention and the spinning device, it is therefore possible to increase the capillary density without increasing the risk of spinning failures. The empirical equation IIIa is then applicable for the distance between two adjacent nozzle holes.

More detailed examinations of the linear planiform blowing on the capillary assemblages shortly before their entry into the spinning bath make it clear that the largely laminar flow of air in the direction of the capillary run suffers a clear disturbance. There is a change in the transition at the phase boundaries capillary/gas and/or air and capillary/spinning bath. The movement of the spinning bath surface during immersion of the capillaries appears calmer. The spinning failures, which start almost exclusively with the mutual contact of the capillaries during entry into the spinning bath, thus become substantially more improbable.

The invention is explained in greater detail in the following example.

EXAMPLE

A press-moist mixture (50.2% dry content), comprised of 188 grams spruce sulfide cellulose (Cuoxam-DP 480), 10 grams cotton linter cellulose (Cuoxam-DP 1907) and 0.4 grams stabilizer is dispersed in 1850 grams NMMO (75% dry content), placed into a kneader with vertical kneading shaft, and 1255 grams of water are distilled off under vacuum and shearing at a temperature of 90° C. Then [the mixture] is converted into a microscopically homogeneous cellulose solution comprised of 11.0% cellulose, 77.1% NMMO and 11.9% water through further "shear-stirring." The relaxation time at a spinning temperature of 85° C. was 3.0 seconds, the zero shearing viscosity was 3450 Pa·s. The solution is formed into threads in a flask spinning apparatus having a warm water-heated spinning nozzle take-up that can take up either four spinning thimbles with 12.5 mm (30 mm division from nozzle center to nozzle center) or 3 spinning thimbles with a diameter of 20.0 mm (40 mm division). The spinning box is below the spinning element, according to FIGS. 2 and 3.

For each experiment, the maximum gap width $a_{max}$ was determined without and with air impaction in accordance with the invention. After the spinning, the filaments were bobbined, washed and cut into stacks of 50 mm, and then brightened and dried. They were then subjected to a textile examination. The results are stated in the tables 1 and 2. The admission of air was performed in the manner described by means of FIGS. 2 and 3 above. The nozzle outlet opening was 150 mm×1 mm. The capillaries came into contact with the flow of air immediately prior to entering the spinning bath. The slot of the air nozzle was directed downward at a slant. The slotted nozzle was approximately 10 mm above the surface of the spinning bath.

The tables show that the blowing of air allows for a significant widening of the air gap a, specifically by at least 50% up to a maximum of 200%, without any failures during the spinning operation. This includes a significant improvement of the elongation at tear, dry, and the loop tear strength.

TABLE 1

| Nmber | Diameter of thimble [mm] | Diameter of boring [mm] | Density of capillaries $cm^{-2}$ | Drawing-off speed m/min | $a_{max}$ [mm] Without | With |
|---|---|---|---|---|---|---|
| 1 | 12 | 0.200 | — | 100/300 | >300 | >300 |
| 2 | 12 | 0.140 | 47 | 100 | 40 | 60 |
| 3 | 12 | 0.140 | 47 | 300 | 60 | 90 |
| 4 | 20 | 0.140 | 15 | 100 | 40 | 80 |
| 5 | 20 | 0.140 | 15 | 300 | 60 | 130 |
| 6 | 20 | 0.140 | 15 | 500 | 80 | 180 |
| 7 | 12 | 0.090 | 47 | 100 | 40 | 70 |
| 8 | 12 | 0.090 | 47 | 300 | 60 | 105 |
| 9 | 20 | 0.090 | 350 | 100 | 10 | 30 |

TABLE 2

| Number | Fineness [dtex] | tensile strength dry [cN/tex] Without | With | Tensile Elongation dry [%] Without | With | Loop tensile strength [cN/tex] Without | With |
|---|---|---|---|---|---|---|---|
| 1[1)] | 1.63 | 41.2 | | 17.8 | | 19.7 | |
| 2 | 1.62 | 42.5 | 41.5 | 13.3 | 16.9 | 13.9 | 15.9 |
| 3 | 1.68 | 44.1 | 42.7 | 11.9 | 15.4 | 11.7 | 14.7 |
| 4 | 1.67 | 41.6 | 40.6 | 14.5 | 17.4 | 14.3 | 16.5 |
| 5 | 1.61 | 43.2 | 42.4 | 12.7 | 15.9 | 11.9 | 15.1 |
| 6 | 1.63 | 44.8 | 43.9 | 10.2 | 14.7 | 9.7 | 14.3 |
| 7 | 1.65 | 42.8 | 42.1 | 13.1 | 17.0 | 13.8 | 14.9 |
| 8 | 1.64 | 44.9 | 43.1 | 11.3 | 15.1 | 11.8 | 13.9 |
| 9 | 1.40 | 43.9 | 43.1 | 12.8 | 16.1 | 14.1 | 15.9 |

[1)]Only 100 m/min drawing off speed

What is claimed is:

1. A method for the production of a cellulose fiber from cellulose according to the dry-wet-extrusion method with an aqueous amine oxide, as a solvent, comprising:

a) dispensing at least one type of cellulose with a Cuoxam-DP in the range of 250 to 3000 in aqueous amine oxide to form a dipersion;

b) converting the dispersion at an increased temperature under dehydration and shearing into a solution with a zero shear viscosity in the range of 600 to 6000 Pa·s and with a relaxation time in the range of 0.3 to 50.5, at 85° C. respectively;

c) supplying the solution to at least one spinning nozzle to form at least one capillary assemblage and guiding the at least one capillary assemblage through an impaction chamber comprising a non-precipitating medium, where the dwelling time of the solution is at least equal to its relaxation time at the spinning temperature;

d) guiding the at least one capillary assemblage, under draught through the non-precipitating medium and then through a downstream spinning bath comprising a precipitating medium for precipitation of cellulose threads and wherein the at least one capillary assemblage is impacted with a gas under an angle $\alpha$ to the direction of the capillary run in a range of $45° < \alpha < 90°$ before the at least one capillary assemblage enters the downstream spinning bath; and e) separating precipitated cellulose threads from a flow of the precipitating medium by deflection at the end of the spinning bath drawing frame and the threads are drawn off.

2. A method for the production of a cellulose fiber from cellulose according to the dry-wet-extrusion method with an aqueous amine oxide, as a solvent, comprising:

a) dispersing at least one type of cellulose with a Cuoxam-DP in the range of 250 to 3000 in the aqueous amine oxide to form a dispersion;

b) converting the dispersion at an increased temperature under dehydration and shearing into a homogeneous solution with a zero shear viscosity in the range of 600 to 6000 Pa·s and with a relaxation time in the range of 0.3 to 50.5, at 85° C. respectively;

c) supplying the solution to at least one spinning nozzle to form at least one capillary assemblage and guiding the at least one capillary assemblage through a impaction chamber comprising a non-precipitating medium, where the dwelling time of the solution is at least equal to its relaxation time at the spinning temperature;

d) guiding the at least one capillary assemblage under draught through the non-precipitating medium and then through the a downstream spinning bath comprising a precipitating medium for precipitation of cellulose threads and wherein the at least one capillary assemblage is impacted with a gas flow shortly before entering the downstream spinning bath, whereby the gas flow and the spinning bath have parallel flow components at a gas gap boundary between the spinning bath and the non-precipitating medium in the impaction chamber; and e) separating precipitated cellulose threads from a flow of the precipitating medium by deflection at the end of the spinning bath drawing frame and the threads are drawn off.

3. The method according to claim 1 the at least one capillary assemblage is impacted by a flat, level gas flow that reaches across the entire width of the capillary assemblages.

4. A device for the production of cellulose fibers from cellulose according to the dry-wet-extrusion method with aqueous amine oxides as solvents, comprising:

(a) a spinning package comprising a spinning plate; at least one spinning nozzle for producing at least one capillary assemblage and a shared impaction chamber arranged above the spinning plate and between the spinning plate and the at least one spinning nozzle, wherein the impaction chamber has a volume according to the following equation $$V \geqq v_L * \lambda_m$$

wherein V represents the volume of the impaction chamber in $cm^3$, $V_L$ the volume flow of a cellulose solution in $cm^3/s$ and $\lambda^m$ the relaxation time at the frequency maximum of the relaxation spectrum of the spinning solution, (b) a spinning bath positioned downstream of the impaction chamber wherein the spinning bath comprises a precipitating medium;

(c) a gap positioned between the at least one spinning nozzle and the surface of the precipitating medium in the spinning bath wherein at least one wide-slot nozzle is arranged in the gap to impact the capillary assemblage with a gas flow directed under an angle $\alpha$ in the range $45° < \alpha < 90°$ before the at least one capillary assemblage enters the spinning bath; and (d) a drawing-off godet.

5. The device according to claim 4, further comprising an upper bath container which comprises the impaction chamber wherein the at least one capillary assemblage is drawn through and also comprises one inlet opening for supplying precipitating medium to the spinning bath and on the outer side of the capillary assemblages at least one overflow and that the wide-slot nozzle is arranged on the same side as the inlet opening(s) with respect to the flow of capillary assemblages.

6. The device according to claim 4, wherein the wide-slot nozzle is mechanically connected to the at least one overflow.

7. The device according to claim 4, wherein the gas gap has a width a according to the equation $$a \leq [5 + 16\lambda_m^{0,6}] \cdot e^{0.002v + \frac{1}{\sqrt{N \cdot D}}}$$

wherein a represents the width of the gap in mm, $\lambda_m$ represents the relaxation time at the frequency maximum of the relaxation spectrum of a spinning solution, $v_a$ represents the drawing-off speed in m/min, N represents the capillary density in $cm^{-2}$ and D represents the diameter of a nozzle hold in mm in a spinning nozzle.

8. The device according to claim 7, wherein the dimensions of the spinning nozzle, the width of the gap a and the spinning bath drawing frame w meet the equation $$x \geq \frac{a + w}{w} \cdot 3,5 \cdot D$$

wherein x represents the distance between two adjacent nozzle holes, a represents the width of the air gap, w represents the length of the spinning bath drawing frame and D represents the diameter of the nozzle hole.

9. The method according to claim 1, wherein the aqueous amine oxide is N-methyl morpholine-N-oxide.

10. The method according to claim 2, wherein the at least one capillary assemblage is impacted by a flat, level gas flow that reaches across the entire width of the capillary assemblage.

* * * * *